US006158510A

United States Patent [19]

Bacon et al.

[11] Patent Number: 6,158,510

[45] Date of Patent: Dec. 12, 2000

[54] STEAM DISTRIBUTION AND PRODUCTION OF HYDROCARBONS IN A HORIZONTAL WELL

[75] Inventors: Russell McNeill Bacon; George Robert Scott; Daryl Gordon Youck; Kai Sun Chan, all of Calgary, Canada

[73] Assignee: ExxonMobil Upstream Research Company, Houston, Tex.

[21] Appl. No.: 09/174,758

[22] Filed: Oct. 19, 1998

[30] Foreign Application Priority Data

Nov. 18, 1997 [CA] Canada ..... 2219513

[51] Int. Cl.[7] ..... E21B 43/24; E03B 3/18

[52] U.S. Cl. ..... 166/272.7; 166/272.3; 166/272.2; 166/303; 166/233; 166/236

[58] Field of Search ..... 166/263, 272.2, 166/272.7, 303, 233, 235, 236, 272.3

[56] References Cited

U.S. PATENT DOCUMENTS

| | | | |
|---|---|---|---|
| 3,994,340 | 11/1976 | Anderson et al. | 166/50 |
| 4,046,199 | 9/1977 | Tafoya | 166/303 |
| 4,416,331 | 11/1983 | Lilly | 166/236 |
| 4,640,359 | 2/1987 | Livesey et al. | 166/303 |
| 5,141,054 | 8/1992 | Alameddine et al. | 166/252.1 |
| 5,289,881 | 3/1994 | Schuh | 166/303 |
| 5,311,942 | 5/1994 | Nagaoka | 166/232 |
| 5,355,948 | 10/1994 | Sparlin et al. | 166/228 |
| 5,411,094 | 5/1995 | Northrop | 166/303 |
| 5,415,227 | 5/1995 | Jennings, Jr. | 166/278 |
| 5,730,223 | 3/1998 | Restarick | 166/235 |
| 5,826,655 | 10/1998 | Snow et al. | 166/272.3 |

FOREIGN PATENT DOCUMENTS 0 786 577 A2 7/1997 European Pat. Off. ..... E21B 43/08

OTHER PUBLICATIONS

Granger, M.J., Strickling, R.W., El–Rabaa, A.M., and Ortez, Y. P. "Horizontal Well Applications in the Guymon–Hugoton Field: A Case Study", *Gas Technology Conference*, Calgary, Alberta, Canada Apr. 28–May 1, 1996, Society of Petroleum Engineers, Inc., Paper No. SPE 35641, pp. 1–10.

Davies, D.K., Mondragon, J.J., and Hara, P.S. "A Novel, Low cost, Well Completion Technique using Steam for Formations with Unconsolidated Sands, Wilmington Field, California", *1997 SPE Annual Technical Conference and Exhibition*, San Antonio, Texas, Oct. 5–8, 1997, Society of Petroleum Engineers, Inc., Paper No. SPE 38793, pp. 433–447.

Montgomery, S.L. "Increasing Reserves in a Mature Giant: Wilmington Field, Los Angeles Basin, Part II: Improving Heavy Oil Production Through Advanced Reservoir Characterization and Innovative Thermal Technologies", *AAPG Bulletin*, V. 82. No. 4 (Apr. 1998), pp. 531–544.

*Primary Examiner*—David Bagnell
*Assistant Examiner*—Jennifer R. Dougherty
*Attorney, Agent, or Firm*—Denise Y. Wolfs

[57] ABSTRACT

A system for enhancing steam distribution in a thermal stimulation phase, and for reducing the production of particulate matter with hydrocarbon fluids in a production phase, has a base pipe with a limited number of spaced-apart holes. The spaced-apart holes are sized and located so that steam is uniformly distributed in the reservoir. A collar is disposed around each hole to deflect the steam into an annulus between the base pipe and a wire-wrap screen section to avoid erosion and deterioration of the wire-wrap screen, which is required in the production phase. Mobilized hydrocarbon fluids flow to the wire-wrap screen section, which acts to filter particulate matter so that the production of particulate matter with hydrocarbon fluid is limited. The open area in the base pipe is significantly reduced, as compared with conventional methods, so that at the design injection rates, the pressure drop through the spaced-apart holes is larger than the pressure drop along the base pipe. During hydrocarbon fluid production, the pressure drop from the reservoir to the spaced-apart holes is low due to the presence of the wire-wrap screens. The open area in the base pipe while significantly reduced at the design production rates, as compared with conventional methods, should not unduly limit production rates.

21 Claims, 1 Drawing Sheet

STEAM DISTRIBUTION AND PRODUCTION OF HYDROCARBONS IN A HORIZONTAL WELL

FIELD OF THE INVENTION

The present invention relates to thermally by stimulated oil recovery in horizontal wells, and in particular, to a method and system for enhancing steam distribution in a thermal stimulation oil recovery operation, and for reducing the production of particulate matter recovered with the hydrocarbon fluids produced.

BACKGROUND OF THE INVENTION

There are many subterranean tar sand deposits throughout the world which contain high viscosity heavy oil. The vast Athabasca and Cold lake deposits in Alberta, Canada represent some of the most notable examples of such formations.

A variety of methods have been proposed for recovering hydrocarbons from these formations by increasing the mobility of the oil. Such methods include thermal stimulation processes including a Cyclic Steam Simulation (CSS) process, a Steam Flood (SF) process and a Steam Assisted Gravity Drainage (SAGD) process. Generally speaking, these processes use steam to heat and mobilize the oil, and then the mobilized oil is recovered using a production well.

In the CSS process, steam is injected through an injection well into the hydrocarbon-bearing formation. The well is shut-in so that the steam soaks in and heat is transferred to the formation to lower the viscosity of the hydrocarbon. In the production phase, oil is pumped from the formation using the same wellbore. Several cycles of steam injection and hydrocarbon production are continued until production becomes too low to justify further steam injection.

The SF process involves injecting steam into the formation through an injection well. Steam moves through the formation, mobilizing oil as it flows toward the production well. Mobilized oil is swept to the production well by the steam drive.

The SAGD process involves injecting steam into the formation through an injection well or wells at a rate which is able to maintain a near constant operating pressure in the steam chamber. Steam at the edges of the steam chamber condenses as it heats the adjacent non-depleted formation. The mobilized oil and steam condensate flow via gravity to a separate production well located at the base of the steam chamber.

One concern in all thermal stimulation processes is the distribution of steam from horizontal wells into the formation. This is accomplished in conventional techniques by providing holes or slots in the casing. In a horizontal well which is used only for steam injection at subfracture reservoir pressures, uniform steam distribution can be achieved by two means—the number and size of holes in the liner can be limited, such that at the desired steam injection rates, critical (sonic) flow is achieved through the holes and equitable steam distribution at each hole location is achieved; or the target steam injection rates can be constrained such that only a minimal pressure drop occurs along the liner. Thus, the pressure gradient available for steam flow between the liner and reservoir at all points on the horizontal well are essentially the same. Both of these design criteria put significant constraints on the steam injection operation. Designing for critical flows means that the peak injection rates are capped. Designing a liner to achieve minimal pressure drops severely restricts the maximum steam injection rates, maximum liner length and minimum liner diameter which can be utilized. Again, this means that the peak injection rates are capped.

In a horizontal well which is used for steam injection at fracture pressures, neither of these steam distribution techniques is adequate. In a reservoir such as the Clearwater formation at Cold Lake, the reservoir fracture pressure is typically 10 to 11 MPa. This pressure is too high to allow the critical flow design option to be successfully utilized. If a conventional liner were used, it is most likely the horizontal well would fracture at only one location along the wellbore, and, in the following steam cycle, it may not be possible to move the fracture to a different portion of the wellbore.

If a steam injection well is also used for oil production, particulate matter (such as sand and other formation fines) can either plug the holes or slots directly if relatively few openings are available, or they can also flow into the well with the produced hydrocarbons. Particulate matter settling inside the well can choke off sections of the well completely, thereby adversely affecting hydrocarbon production and steam injection in the following cycles.

In an effort to minimize the production of particulate matter with hydrocarbon fluids, well casings are often provided with a slotted liner or an external wire-wrap screen extending over a portion of the length of the horizontal portion of the well. Such liners and screens are available from Site Oil Tools Inc, Bonneyville, Alberta, Canada. In wire-wrap applications, holes are drilled in the well casing below the wire-wrap screens to provide an open area of about 8%. To achieve this degree of open area, hundreds of ⅜ in (0.95 cm) diameter holes are required. For example, for a typical 8⅝ in (21.9 cm) diameter pipe, 246⅜ in (0.95 cm) holes are required per foot length of pipe to give an open area of 8.4%. The ratio of screened to blank sections of pipe is determined by the average % open area one wants for the application. Typically, the ratio is set to allow 1.5 to 3% of the base pipe to be open area. This relatively large open area is provided to minimize pressure drop constraints on and velocities of the fluids being produced from the reservoir. An external wire-wrap screen is then placed around the casing to reduce the flow of particulate matter through the holes. Slotted liners typically have corresponding open areas provided with the slots cut into the liner. In these designs, essentially no flow restrictions occur as the fluids pass through the slots or wire-wrap screen assemblies. Corresponding high velocities may expose the liner to erosion by the entrained sand.

An example of known techniques for distributing steam is described in U.S. Pat. No. 5,141,054 (Mobil), which relates to a limited entry steam heating method for distributing steam from a closed-end tubing in a perforated well casing. The tubing string has perforations to achieve critical flow conditions such that the steam velocity through the holes in the close-end tubing reach acoustic speed. However, due to the large annulus flow area, plus the still large number of holes in the well casing, critical flow is not maintained in the wellbore annulus and through the casing into the reservoir, so that the desired steam distribution control is lost.

It is an object of the present invention to provide a system and method for distributing steam and producing hydrocarbons from the same well.

It is another object of the present invention to enhance steam distribution during a thermal stimulation phase, and to reduce the influx of particulate matter during a production phase, for a well.

It is a further object of the present invention to provide a system and method where steam injection may occur at pressures below, up to, or exceeding the reservoir fracture pressure.

SUMMARY OF THE INVENTION

According to one aspect of the present invention, there is provided a system for distributing steam in a steam injection phase and for producing hydrocarbon fluids in a production phase from a horizontal well in a reservoir, comprising: a base pipe having a plurality of spaced-apart orifices in the wall thereof; a plurality of second pipe sections disposed around the base pipe, and means for spacing each second pipe section from the base pipe to form an annulus between the base pipe and each second pipe section; each second pipe section having distribution means for distributing steam in the steam injection phase and for minimizing influx of particulate matter in the production phase; each second pipe disposed around a portion of the base pipe such that at least a portion of the distribution means is disposed over an orifice; whereby steam flowing through the base pipe flows outwardly through the plurality of orifices and is distributed outwardly to the reservoir through the distribution means during the steam injection phase; and, in the production phase, hydrocarbon fluids flow inwardly through the distribution means to the orifices and into the base pipe.

According to another aspect of the present invention, there is provided a method for distributing steam and producing hydrocarbon fluids from a horizontal well in a reservoir, comprising the steps of: injecting steam into a base pipe having a plurality of orifices in the wall thereof; a plurality of second pipe sections disposed around the base pipe, and means for spacing each second pipe section from the base pipe to form an annulus between the base pipe and each second pipe section; each second pipe section having a distribution means for distributing steam, each second pipe section disposed around a portion of the base pipe such that at least a portion of the distribution means is disposed over the orifices, such that steam flows outwardly from the orifices to the distribution means of each second pipe section into the reservoir such that hydrocarbon fluids in the reservoir become mobile; and producing mobile hydrocarbon fluids by discontinuing steam injection and allowing mobile hydrocarbon fluids to flow through the distribution means into the annulus between each second pipe section and the base pipe such that influx of particulate matter is minimized.

According to a further aspect of the present invention, there is provided a method for distributing steam and producing hydrocarbon fluids from a horizontal well in a reservoir, comprising the steps of: injecting steam into a horizontal injection well comprising a base pipe having a plurality of orifices in the wall thereof; a plurality of second pipe sections disposed around the base pipe, and means for spacing each second pipe section from the base pipe to form an annulus between the base pipe and each second pipe section; each second pipe section having distribution means for distributing steam, each second pipe section disposed around the base pipe such that at least a portion of the distribution means is disposed over the orifices, such that steam flowing outwardly from the orifices is deflected by the distribution means of each second pipe section into the reservoir such that hydrocarbon fluids in the reservoir become mobile; and producing mobile hydrocarbon fluids by pumping from a production well.

DETAILED DESCRIPTION OF THE PREFERRED EMBODIMENTS

The present invention is a method and system for thermal stimulation and hydrocarbon production in a horizontal well, using the same well casing for both the thermal stimulation and hydrocarbon production phases.

The present invention is particularly suited to CSS, SF and SAGD processes for the control of steam distribution during a steam injection phase, and the control of influx of particulate matter during the production phase. It will be understood that the well casing of the present invention may also be used for injection of other miscible or immiscible agents useful in hydrocarbon recovery.

The system of the present invention provides enhanced steam distribution and maximizes hydrocarbon production, even though the criteria for the two phases are in opposition. In conventional systems, the size and number of holes is large to reduce the pressure drop across the holes during the production phase. However, well casings used specifically for injection ideally have a reduced number of holes to increase the pressure drop of the steam through the holes.

In accordance with the present invention, a common set of holes is used for both steam distribution and hydrocarbon production phases. Accordingly, a well of the present invention can be used for both thermal stimulation and/or hydrocarbon production phases.

Figure 1:
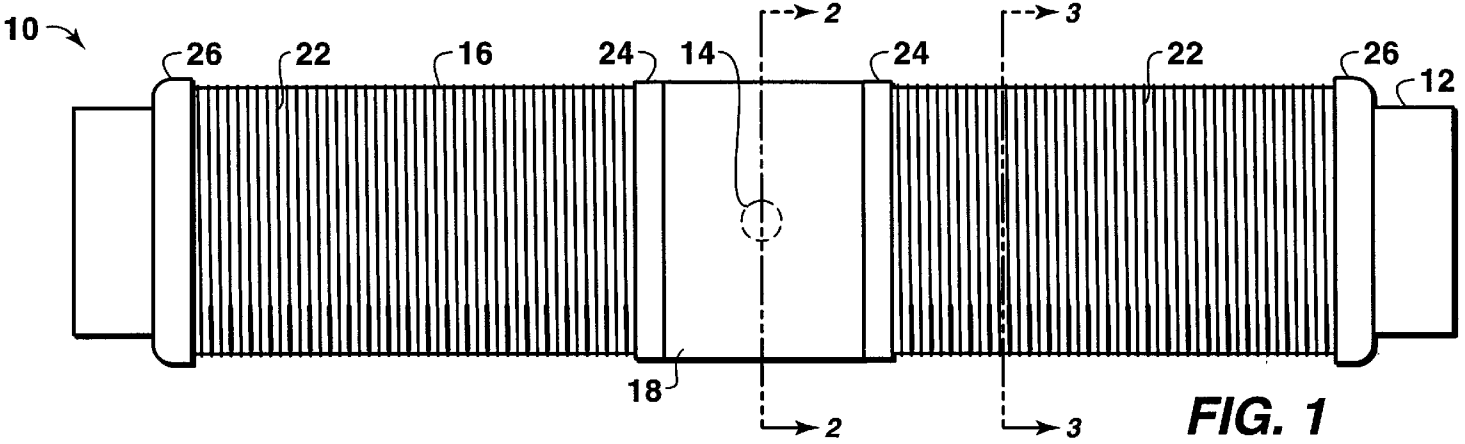
FIG. 1 is a side elevation view of the system of the present invention.

Referring now to FIG. 1, the system of the present invention has a base pipe 12 with an orifice 14 in the pipe wall. A second pipe 16 is disposed over a section of the base pipe 12 having the orifice 14. The second pipe 16 has a collar 18 and sections of wire-wrap screen 22 connected to either side of the collar 18 by connector rings 24. The second pipe 16 is disposed over the base pipe 12 such that the collar 18 is positioned over the orifice 14. The wire-wrap screen sections 22 are secured at the opposite end of the base pipe 12 by boss rings 26.

Figure 2:
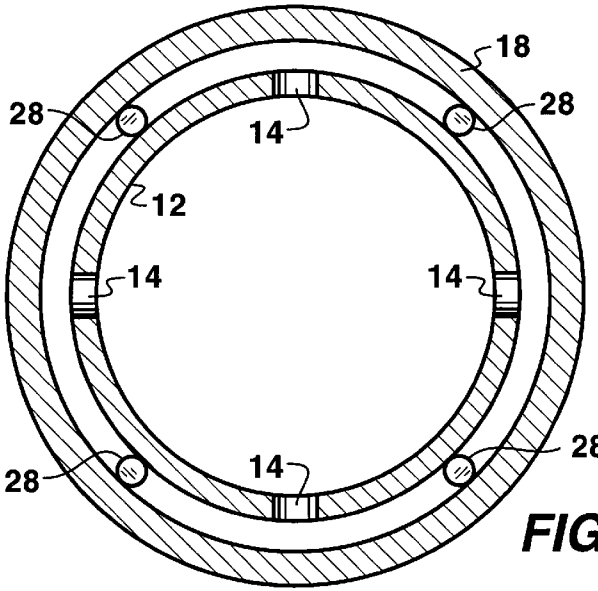
FIG. 2 is a cross-sectional view of the system of FIG. 1 along the line 2—2 in FIG. 1.
Figure 3:
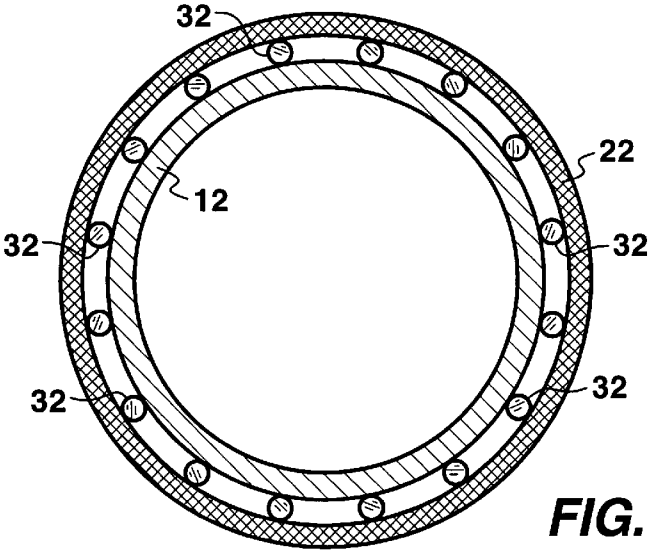
FIG. 3 is a cross-sectional view of the system of FIG. 1 along the line 3—3 in FIG. 1.

As shown more clearly in FIG. 2, the collar 18 is spaced from the base pipe 12 by rods 28 or the like to provide an annulus. Support ribs 32 are used to space the wire-wrap screen sections 22 from the base pipe 12 to form an annulus in communication with the annulus between the base pipe 12 and the collar 18. This is shown more clearly in FIG. 3.

Alternatively, the collar 18 can be connected on either side to a section of slotted liner or other sand control device (not shown), instead of a wire-wrap screen. Such liners and screens are available, for example, from Site Oil Tools, Inc., Bonnyville, Alberta, Canada.

Further, the collar 18 may be omitted. If in the proposed application, potential erosion of the screens is not a concern, the collar may be replaced with a section of wire-wrap screen or other similar device.

The number of orifices 14 in a length of base pipe 12 is reduced in the system of the present invention, as compared with conventional techniques, to increase the pressure drop across the orifices 14. The collar 18 and the wire-wrap screen sections 22 allow the steam to exit uniformly across the wire-wrap screen section 22 into the reservoir. The collar 18 preferably has a wall thickness which can withstand the force of the steam impacting the collar 18. Where the velocity of the steam is lower, the steam will distribute along the wire-wrap screen without the need for the collar.

In a situation in which steam injection at the design injection rates for the specific application is occurring at pressures less than the reservoir fracture pressure, the higher the pressure drop ratio is between that through the orifice 14 and that along the base pipe 12, the smaller will be the steam maldistribution occurring along the base pipe 12. Variations in reservoir quality and oil saturation along and external to the base pipe 12 will result in differences in the transmissibility of the steam at each orifice 14 location. In areas of the high steam transmissibility, the steam rate through the orifice 14 will increase. However, as the steam rate increases, the pressure drop through the orifice 14 also increases. This will reduce the maximum injection rate achievable through orifice 14. In areas with low steam transmissibility, the steam rate through the orifice 14 will decrease. However, as the steam rate decreases, the pressure drop through the orifice 14 also decreases. This will increase the minimum injection rate achievable through the orifice 14. Application of this design feature helps compensate for variations in reservoir quality along the base pipe 12 and thus, assists in improving the steam distribution into the reservoir along the base pipe 12. To ensure that it is not possible to fracture the reservoir at an orifice 14 where steam transmissibility is low, the steam pressure within the base pipe 12 should be maintained at less than the reservoir fracture pressure.

In a situation in which steam injection at the design injection rates for the specific application is occurring at or above reservoir fracture pressure, it is also necessary to ensure that pressure drop across the orifice 14 is larger than the expected variation in the reservoir fracture pressure along the base pipe 12. This will ensure that the steam exiting each orifice 14 along the base pipe 12 is capable of fracturing the reservoir at that location. Steam maldistribution can be reduced by insuring that the orifice 14 pressure drop at the design injection rates is significantly higher than the expected variability in the reservoir fracture pressure along the base pipe 12.

In use, sections of the base pipe 12 are joined together to provide a predetermined number of orifices 14 along the length of the horizontal well. For example, to inject 1,500 $m^3$/d (cold water equivalent) of 11 MPa steam (70% quality) into a reservoir, twenty ½ in (1.27 cm) diameter holes would be required to achieve a pressure drop of 500 kPa across the orifices 14. The desired pressure drop is dependent on the reservoir fracture pressure and the variations thereof along the length of the well. The pressure drop across the orifices 14 is affected by the number and size of holes available for flow and the spacing thereof, and the diameter of the base pipe 12.

In conventional systems, the open area is too large to create a pressure constraint on fluids injected or produced. In accordance with the present invention, the deflection of high pressure steam through a limited number of holes creates good distribution during injection and the entry points available across the wire-wrap screen sections 22 allow for low pressure drop during production. The ½ in (1.27 cm) diameter holes of the system of the present invention can be spaced 25 m apart, as compared to the 246⅜ in (0.95 cm) diameter holes per foot in a conventional system. For example twenty ½ in (1.27 cm) diameter holes in a 500 m length 5½ in (14.0 cm) diameter pipe represents an open area of 0.0012%. A person of ordinary skill in the art will understand that the structural integrity of a base pipe having an open area of 0.0012% is significantly greater than a conventional pipe having an open area of 8.4%, as discussed earlier. The cost of the base pipe of the present invention is reduced significantly, because the number of holes which must be cut in the base pipe is reduced drastically, and the wall thickness of the present invention need not be as great to support the number of holes being cut.

Preferably, the number and size of orifices 14 in the base pipe 12 is such that there is provided an open area of less than 0.5%. More preferably, the open area in the base pipe 12 is less than 0.1%. Even more preferably, the open area in the base pipe 12 is less than 0.01%.

For example, by spacing the twenty ½ in (1.27 cm) diameter holes equally along a 500 m long 5½ in (14.0 cm) diameter base pipe 12, the level of steam maldistribution (defined as 0.5 times the ratio of the steam injection rate through the first and last holes) when injecting 1,500 $m^3$/d of high pressure steam (70% quality) into a reservoir with a reservoir fracture pressure of 10 MPa would be less than 10%. In this example, the pressure drop is less than 50 kPa across the orifices in the production phase when the production rate is 300 $m^3$/d of liquids and 21,000 standard $m^3$/d of wet vapors and the near wellbore reservoir is 500 kPa. This example illustrates that excellent distributions of both injected steam and produced fluids can be achieved through correctly sized and distributed orifices.

The system of the present invention can be set-up, for example, such that a 1 meter long collar is positioned over the orifice 14 and is connected to a 3 meter long wire-wrap screen on either side thereof As a result of the reduced number of orifices, the steam exits the base pipe 12 at each orifice 14 and the wire-wrap screens 22 on either side of the collar 18 effectively distribute the steam into the reservoir.

In a CSS process, steam is injected into the base pipe 12 and exits through the orifices 14. Steam is deflected off the collar 18 to the wire-wrap screen sections 22 for distribution into the reservoir. Heat is transferred to the reservoir to mobilize the hydrocarbon fluids. In the production phase, steam injection is discontinued and mobilized hydrocarbon fluids are allowed to flow to the distribution means which act to screen any particulate matter from the fluid. Hydrocarbon fluid then travels in the annulus between the second pipe 16 to the orifice 14 into the base pipe 12 and is pumped to surface. Preferably, the steam injection and hydrocarbon fluids production steps are repeated cyclically.

In a SAGD process, steam is injected into the base pipe 12 and exits through the orifices 14. Steam is deflected off the collar 18 to the wire-wrap screen sections 22 for distribution into the reservoir. The number of orifices is constrained, such that the pressure drop through the orifices 14 is larger than the pressure drop along the liner itself. This ensures the equal distribution of steam along the injector and that either longer injectors and/or smaller diameter liners can be utilized. Heat is transferred to the reservoir to mobilize the hydrocarbon fluids. The mobilized hydrocarbon fluids drain to a production well where it is pumped to the surface. The production well may also comprise a base pipe 12 having orifices 14 with wire-wrap screen sections 22 disposed around the base pipe 12, and an annulus between the base pipe 12 and the wire-wrap screen sections 22. Mobile hydrocarbon fluids then flow through the annulus to the orifice 14 and into the base pipe. The number of orifices is constrained such that the pressure drop through the orifices 14 is larger than the pressure drop through either the wire-wrap screen sections 22 or along the liner itself. Shifting of the key flow restriction away from the wire-wrap sections 22 prevents excessive fluid velocities from mobilizing sand and thus eroding the screens. Having the pressure drops through the orifices 14 much larger than the pressure drop along the liner, ensures that the pressure drop within the liner does not adversely affect the inflow performance of the production well and thus, more uniform hydrocarbon fluid influx occurs along the wellbore. This design feature will allow the utilization of longer producers and/or smaller diameter producers. A second benefit of this design feature is that at sections of the wellbore which are coning steam from the steam chamber, the presence of the limited number of orifices restricts the rate which steam can enter the production wellbore. This reduces steam or condensate production without adversely affecting the hydrocarbon fluid production from the remaining section of the wellbore.

In a SF process, steam is injected into the base pipe 12 and exits through the orifices 14. Steam is deflected off the collar 18 to the wire-wrap screen sections 22 for distribution into the reservoir. The number of orifices is constrained such that the pressure drop through the orifices 14 is larger than the pressure drop along the liner itself. This ensures the equal distribution of steam along the injector and that either longer injectors and/or smaller diameter liners can be utilized. Heat is transferred to the reservoir to mobilize the hydrocarbon fluids. The mobilized hydrocarbon fluids are displaced to a production well where it is pumped to the surface. The production well may also comprise a base pipe 12 having orifices 14 with wire-wrap screen sections 22 disposed around the base pipe 12 and an annulus between the base pipe 12 and the wire-wrap screen sections 22. Mobile hydrocarbon fluids then flow through the annulus to the orifice 14 and into the base pipe 12. The number of orifices is constrained such that the pressure drop through the orifices 14 is larger than the pressure drop through either the wire-wrap screen sections 22 or along the liner itself. Shifting of the key flow restriction away from the wire-wrap sections 22 prevents excessive fluid velocities from mobilizing sand and thus eroding the screens. Having the pressure drops through the orifices 14 much larger than the pressure drop along the liner ensures that the pressure drop within the liner does not adversely affect the inflow performance of the production well, and thus, either longer producers and/or smaller diameter producers can be utilized.

The above-described embodiments of the present invention are meant to be illustrative of preferred embodiments and are not intended to limit the scope of the present invention. Various modifications, which would be readily apparent to one skilled in the art, are intended to be within the scope of the present invention.

We claim:

1. A system for distributing steam in a steam injection phase and for producing hydrocarbon fluids in a production phase from a horizontal well in a reservoir, comprising:

a base pipe having a plurality of spaced-apart orifices in the wall thereof, wherein the plurality of orifices represent an open area in the base pipe of less than 0.5%; a plurality of second pipe sections disposed around the base pipe, and means for spacing each second pipe section from the base pipe to form an annulus between the base pipe and each second pipe section;

each second pipe section having distribution means for distributing steam in the steam injection phase and for minimizing influx of particulate matter in the production phase; each second pipe disposed around the base pipe such that at least a portion of the distribution means is disposed over an orifice; and whereby steam flowing through the base pipe flows outwardly through the plurality of orifices and is distributed outwardly to the reservoir through the distribution means during the steam injection phase; and, in the production phase, hydrocarbon fluids flow inwardly through the distribution means to the orifices and into the base pipe.

2. The system of claim 1, wherein the distribution means includes at least one collar disposed over one of the plurality of orifices in the base pipe when the second pipe is disposed around the base pipe.

3. The system of claim 2, wherein the distribution means includes a wire-wrap screen.

4. The system of claim 2, wherein the distribution means includes a slotted liner.

5. The system of claim 2, wherein the distribution means includes a steel wool screen.

6. The system of claim 2, wherein the distribution means is connected to each side of the collar.

7. The system of claim 6, wherein the plurality of orifices represent an open area in the base pipe of less than 0.1%.

8. The system of claim 6, wherein the plurality of orifices represent an open area in the base pipe of less than 0.01%.

9. The system of claim 8, wherein the steam injection into the reservoir occurs at pressures less than the reservoir fracture pressure.

10. The system of claim 8, wherein the steam injection into the reservoir occurs at pressures equal to or greater than the reservoir fracture pressure.

11. A method for distributing steam and producing hydrocarbon fluids from a horizontal well in a reservoir, comprising the steps of:

injecting steam into a base pipe having a plurality of orifices in the wall thereof, wherein the plurality of orifices represent an open area in the base pipe of less than 0.5%; a plurality of second pipe sections disposed around the base pipe, and means for spacing each second pipe section from the base pipe to form an annulus between the base pipe and each second pipe section; each second pipe section having a distribution means for distributing steam, each second pipe section disposed around the base pipe such that at least a portion of the distribution means is disposed over the orifices, such that steam flows outwardly from the orifices to the distribution means of each second pipe section into the reservoir such that hydrocarbon fluids in the reservoir become mobile; and producing mobile hydrocarbon fluids by discontinuing steam injection and allowing mobile hydrocarbon fluids to flow through the distribution means into the annulus between each second pipe section and the base pipe such that influx of particulate matter is minimized.

12. The method of claim 11, wherein the injecting and producing steps are repeated cyclically.

13. A method for distributing steam and producing hydrocarbon fluids from a reservoir, using two wells, comprising the steps of:

injecting steam into a horizontal injection well including a base pipe having a plurality of orifices in the wall thereof, wherein the plurality of orifices represent an open area in the base pipe of the horizontal injection well of less than 0.5%; a plurality of second pipe sections disposed around the base pipe, and means for spacing each second pipe section from the base pipe to form an annulus between the base pipe and each second pipe section; each second pipe section having distribution means for distributing steam, each second pipe section disposed around the base pipe such that at least a portion of the distribution means is disposed over the orifices, such that steam flowing outwardly from the orifices is deflected by the distribution means of each second pipe section into the reservoir such that hydrocarbon fluids in the reservoir become mobile; and producing mobile hydrocarbon fluids by pumping from a production well.

14. The method of claim 13, wherein the production well includes a base pipe having a plurality of orifices in the wall thereof, and wherein the plurality of orifices represent an open area in the production well base pipe well of less than 0.5%; a plurality of second pipe sections disposed around the production well base pipe, and means for spacing each production well second pipe section from the production well base pipe to form an annulus between the production well base pipe and each production well second pipe section; each production well second pipe section having distribution means, each production well second pipe section disposed around the production well base pipe such that mobile hydrocarbon fluids flow through the production well distribution means into the annulus between each production well second pipe section and the production well base pipe such that influx of particulate matter is minimized.

15. The method of claim 14, wherein the distribution means for both the injection well and the production well includes at least one collar disposed over one of the plurality of orifices in the base pipe when the second pipe is disposed around the base pipe.

16. The method of claim 15, wherein the distribution means for at least one of the wells, includes a wire-wrap screen.

17. The method of claim 15, wherein the distribution means for at least one of the wells includes a slotted liner.

18. The method of claim 15, wherein the distribution means for at least one of the wells includes a steel wool screen.

19. The method of claim 15, wherein the distribution means for at least one of the wells is connected to each side of the collar.

20. The method of claim 15, wherein the plurality of orifices represent an open area in the base pipe of the horizontal injection well of less than 0.1%, and an open area in the base pipe of the production well of less than 0.1%.

21. The method of claim 15, wherein the plurality of orifices represent an open area in the base pipe of the horizontal injection well of less than 0.01%, and an open area in the base pipe of the production well of less than 0.01%.

* * * * *